US005747783A

United States Patent [19]

Myung et al.

[11] Patent Number: 5,747,783

[45] Date of Patent: May 5, 1998

[54] METHODS AND APPARATUS FOR CHANGING THE COLOR OF ILLUMINATION OF A COOKING CHAMBER OF A MICROWAVE OVEN

[75] Inventors: Soon-Hwan Myung, Suwon; Sang-Jin Kim, Anyang; Chya-Hyung Lee, Suwon; Jea-Wook Park; Ho Seok Yun, both of Seoul, all of Rep. of Korea

[73] Assignee: Samsung Electronics Co., Ltd., Suwon, Rep. of Korea

[21] Appl. No.: 626,142

[22] Filed: Apr. 5, 1996

[30] Foreign Application Priority Data

| | | | |
|---|---|---|---|
| Apr. 7, 1995 | [KR] | Rep. of Korea | 95-8119 |
| Jun. 30, 1995 | [KR] | Rep. of Korea | 95-15980 |
| Dec. 7, 1995 | [KR] | Rep. of Korea | 95-47508 |

[51] Int. Cl.[6] ..... H05B 6/68

[52] U.S. Cl. ..... 219/758; 219/720; 362/92

[58] Field of Search ..... 219/758, 720; 362/92

[56] References Cited

U.S. PATENT DOCUMENTS

| | | | |
|---|---|---|---|
| 4,129,769 | 12/1978 | Takagi et al. | 219/758 |
| 4,795,873 | 1/1989 | Freedman et al. | 219/758 |
| 5,180,598 | 1/1993 | Jozefowicz | 219/720 |

FOREIGN PATENT DOCUMENTS

| | | |
|---|---|---|
| 64-41727 | 2/1989 | Japan . |
| 4-136623 | 5/1992 | Japan . |

*Primary Examiner*—Philip H. Leung

*Attorney, Agent, or Firm*—Burns, Doane, Swecker & Mathis, L.L.P.

[57] ABSTRACT

A cooking chamber of a microwave oven is illuminated during a given cooking operation. During that cooking operation the color of the illumination is changed in accordance with the progress of the cooking operation, such as the progress of the cooking time or the temperature of food being cooked, to enable the cooking progress to be visually monitored from a distance.

9 Claims, 8 Drawing Sheets

METHODS AND APPARATUS FOR CHANGING THE COLOR OF ILLUMINATION OF A COOKING CHAMBER OF A MICROWAVE OVEN

BACKGROUND OF THE INVENTION

1. Field of the Invention

The present invention relates to methods and apparatus for changing the color of illumination of a cooking chamber of a microwave oven.

2. Description of the Prior Art

Generally, a microwave oven provided with an illumination apparatus comes in various shapes. By way of example, there is a microwave oven utilizing only microwave energy and, a combination microwave oven utilizing a special grill method and hot air and the like.

An illumination apparatus in a microwave oven is generally mounted at a ceiling or at a predetermined postion of a lateral wall surface in a cooking chamber.

As a light source of such illumination apparatus, a lamp, an incandescent electric lamp or the like is mounted to a fixing member disposed at the ceiling or a wall surface in the cooking chamber.

However, these kinds of illumination apparatus call for lots of requirements to be considered.

In other words, the cooking chamber should be illuminated in an adequate luminous intensity and the quality of material for a lamp fixing member in the cooking chamber should not exceed the limit of a permissible allowance in the degree of leakage of microwaves. Under any circumstances, leakage of the microwaves should be maintained under an internationally recognized regulation.

A microwave oven according to the prior art includes, as illustrated in FIG. 1, a cooking chamber 3 formed in a body 1 for receiving food and for heated cooking thereof, a door 5 coupled at one side of the cooking chamber 3 for opening an closing the cooking chamber 3, a turn table 4 rotatatively disposed on a floor of the cooking chamber 3 to turn the food and, a mechanical room 7 partitioned by one lateral wall unit 2 of the body 1. An electrical supply means 9 mounted at one side of the floor of the mechanical room 7 in order to is generate a high voltage and, a magnetron 11 is provided for receiving the high voltage of the electrical source supply means 9 in order to generate high frequency. A wave guide 13 is disposed between the magnetron 11 and the cooking chamber 3 in order to guide the high frequency generated from the magnetron 11 into the cooking chamber 3, and a blower means 15 is arranged at the mechanical room 7 in order to exhaust hot air for protection of the mechanical room 7. A plurality of suction inlets 17 is formed in a rear wall of the mechanical room 7 in order to allow outside air to be drawn-in-by the blower means 15 and, a plurality of exhaust outlets 21 is provided in an upper left wall surface of the cooking chamber 3 in order to exhaust the outside air drawn into the cooking chamber. A lamp 20 is mounted at an upper right wall surface of the cooking chamber 3 in order to illuminate an interior of the cooking chamber 3 through a plurality of project holes 19 formed in a right lateral wall surface of the cooking chamber 3 and, a duct 23 is mounted at a front upper surface of the mechanical room 7 in order to exhaust the air infused into the mechanical room 7 through the suction inlets 17. A manipulation unit 25 provided with manipulation buttons for establishing operation control, heating time condition according to the food and the like.

In the conventional microwave oven constructed as above, when the food (F) is placed on the turn table 4 in the cooking chamber 3, the door 5 is closed and the microwave oven is put into operation by way of manipulating buttons at the manipulation unit 25 whereby, the high voltage is applied to the magnetron 11 through the electric source supply means 9.

Accordingly, high frequency is generated from the magnetron 11, which is, in turn, moved along the wave guide 13 and introduced into the interior of the cooking chamber 3 to thereby cause the food (F) to be heated and cooked.

At this time, as the electric source supply means 9 and the magnetron 11 are put into operation, the heat generated therefrom is cooled by external cool air infused by the blower means 15 through the suction inlet 17, and the air heat-exchanged by the heat and the cool air is discharged outside of the body 1 through the duct 23.

While the food (F) is being cooked and the door 5 is being opened, the lamp 20 serves to illuminate the cooking chamber 3 through the project holes 19 at a predetermined luminous intensity.

As another prior art, there is disclosed an illumination apparatus of a microwave oven as illustrated in FIG. 2. Throughout the drawing, like reference numerals as in FIG. 1 are used for designation of like or equivalent parts or portions.

The microwave oven is formed with a cooking chamber 3 for accommodating the food in a body 1, and a lamp 20 is centrally provided at a ceiling 26 of the cooking chamber 3.

At this location, the ceiling 26 in the cooking chamber for installing an illumination apparatus therein is centrally provided with a cylindrical through hole 27 of a predetermined diameter, in which an arch-shaped glass cover 28 for protecting the lamp 20 is disposed.

Furthermore, the lamp 20 is insertedly fixed at a lamp outlet 29 to which an electric cord for supplying an electric current is connected.

The outlet 29 is arranged with a dome-shaped reflective lamp shade 31 serving as an enclosure thereof for the lamp 20, so that light emitted from the lamp 20 can be reflected to a predetermined direction.

A unit comprised of the lamp 20, outlet 29, reflective lamp shade 31, protective glass cover 28 and the like is fixedly mounted by an elastic supporting member 32.

Reference numerals **33*a* and 33*b* designate fixing members for fixing the supporting member 32 and reference numeral 11** designate a magnetron.

In the conventional microwave oven thus constructed, when a cooking start button (not shown) is manipulated by a user, the lamp 20 is lit along with the start of the cooking and the cooking of the food is performed under the illumination of the cooking chamber 3.

As another prior art for a heating cooker, is disclosed in Japanese laid open utility model application No.Hei 5-32903 and depicted in FIG. 3, wherein the heating cooker is provided with an illumination apparatus for illuminating depending upon which of a plurality of different cooking modes has been selected by a user.

The illumination apparatus is provided with an illumination lamp 20 in the cooking chamber and a plurality of lamp filters 22 employing respectively different colors, as illustrated in FIG. 3.

The lamp filters 22 are integrally and inter-connectedly formed and provided with a selection switch 24 for selecting the cooking modes to which the lamp filters 22 are connectedly assembled.

In the heating cooking thus constructed as illustrated in FIG. 3, the food cooking is performed according to the cooking time, heating temperature and the like established by control means (not shown) and according to the cooking mode user through use of the selected by the selection switch 24.

At this time, a different color is illuminated in the cooking chamber corresponding to the selected cooking mode.

In other words, a lamp filter 22 corresponding to the cooking mode selected by the selection switch 24 is put into operation, and the light emitted from the lamp 20 is converted to a color contained in the lamp filter 22 to thereby illuminate the cooking chamber 3 through a project hole 30.

However, there is a problem in the conventional microwave oven in that the lamp 20 emits light when the oven is put into operation or the door 5 is opened, for illuminating an interior of the cooking chamber, but in order to ascertain whether the food is cooked, a user must still approach the body 1, and look into the cooking chamber personally through a peep hole.

In other words, although the heating cooker according to the Japanese laid open utility model publication No. Hei 5-32903 is provided with a plurality of colors, so that a different color serves to illuminate the cooking chamber according to the selected cooking mode, this is just a color change per the selected cooking mode, so that the cooking condition (cooked state of the food) in the cooking chamber cannot be ascertained at a relatively long distance from the oven.

SUMMARY OF THE INVENTION

Accordingly, the present invention is disclosed to solve the aforesaid problems and it is an object of the present invention to provide an illumination apparatus of microwave oven a and a control method thereof by which an illumination color in a cooking chamber is changed during the same cooking operation according to the progress of the cooking process so that a user can ascertain visually the condition of the cooking process in the chamber.

In accordance with a first embodiment of the present invention, there is provided an illumination apparatus of a microwave oven, the apparatus comprising:

a plurality of illumination means for illuminating a cooking chamber with respetively different colors; and driving means for driving the plurality of illumination means.

In accordance with the first embodiment of the present invention, where is provided a control method of the illumination apparatus of a microwve oven, the method comprising the steps of:

inputting a predetermined data for cooking;

dividing the input data into mutually different plural color portions according to cooking progressive time steps;

reducing the divided data gradually according to the time steps; and lighting up a lamp of corresponding color according to the respective progressive time steps by comparing a time progressive reference value for each established step with an actually progressed time.

In accordance with a second embodiment of the present invention, there is provided an illumination apparatus of a microwave oven employing a cooking chamber formed with a predetermined space therein for cooking food, a magnetron for generating high frequency for cooking the food, and a turning dish for evenly transmitting the high frequency generated from the magnetron to the food, the apparatus coomprising:

color changing illumination means for being changed to a plurality of colors according to a cooking condition of the food placed on the turning dish; and control means for controlling overall operations of the color changing illustration means.

In accordance with the second embodiment of the present invention, there is provided a control method of an illumination apparatus of a microwave oven, the method comprising the steps of:

inputting a predetermined data for cooking;

dividing the input data into mutually different plural color portions according to cooling progressive time steps;

reducing the divided data gradually according to the time steps; and controlling drive of a motor according to the respective progressive time by comparing a time progressive reference value for each established step with an actually progressed time.

BRIEF DESCRIPTION OF THE DRAWINGS

For a more complete understanding of the nature and objects of the invention, reference should be made to the following detailed description taken in conjunction with the accompanying drawings in which.

DETAILED DESCRIPTION OF PREFERRED EMBODIMENTS OF THE INVENTION

Now, an illumination apparatus of a microwave oven according to the first embodiment of the present invention will be described in detail.

Figure 1:
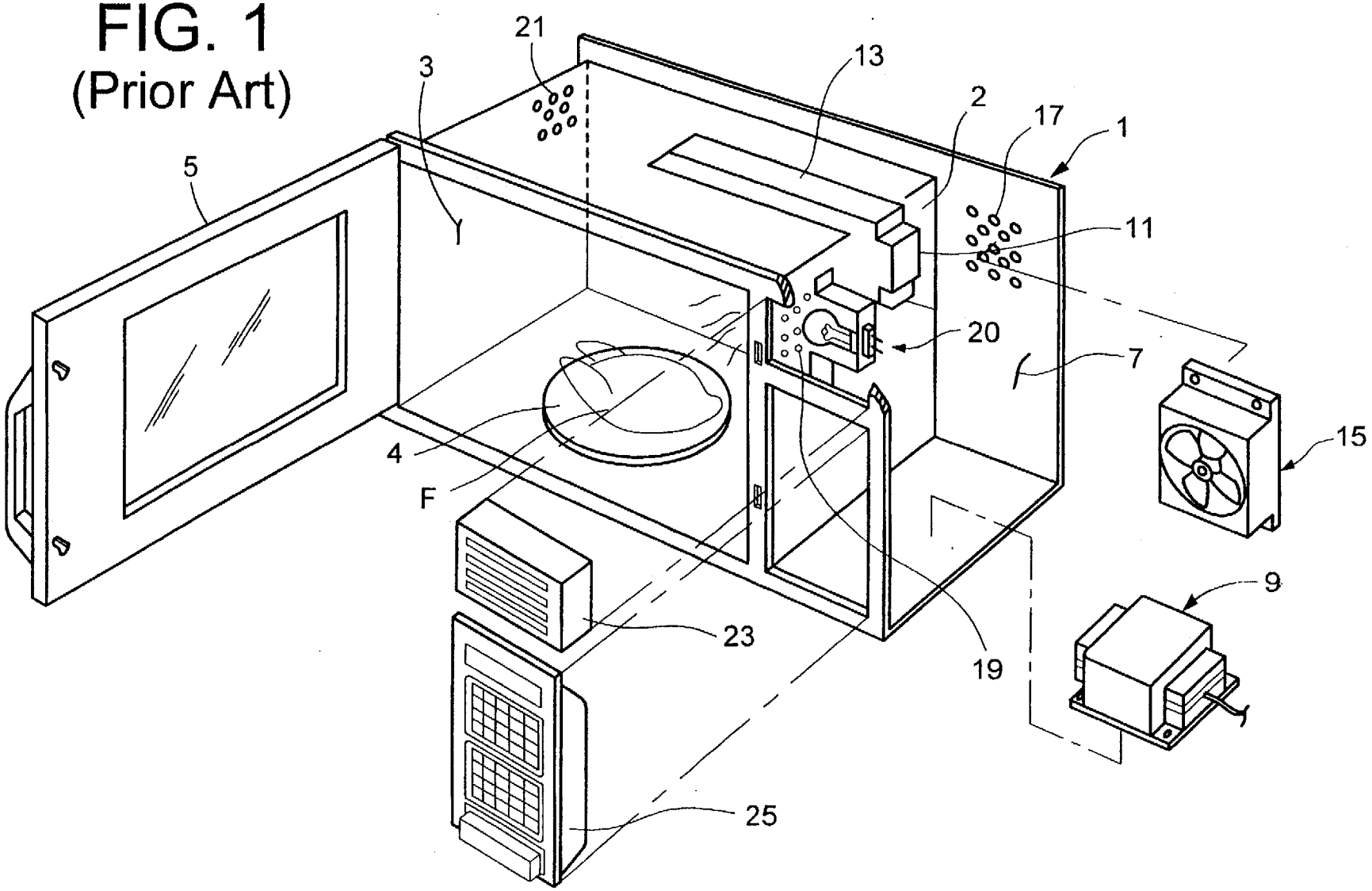
FIG. 1 (Prior Art)
FIG. 1 is a schematic exploded perspective view of a first microwave oven according to the prior art.
Figure 2:
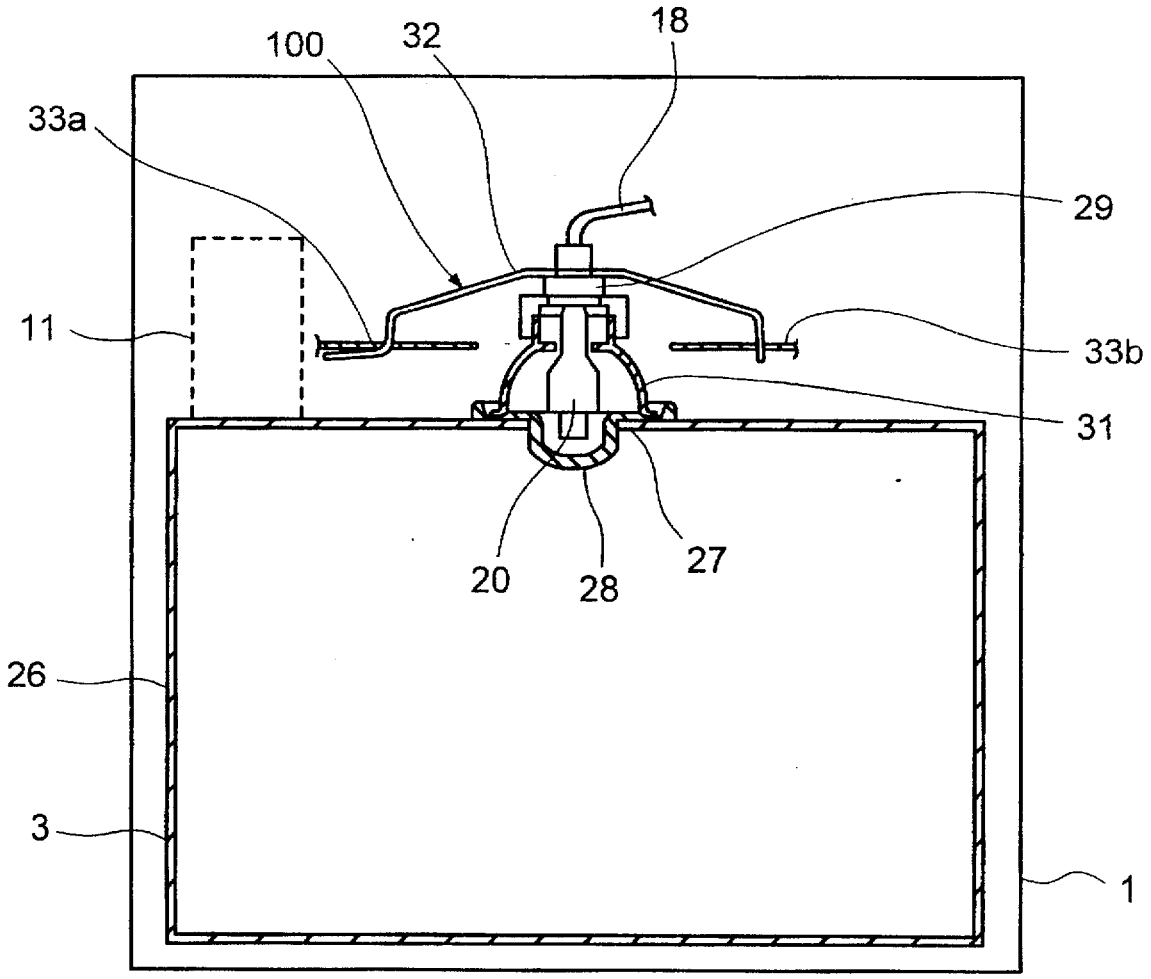
FIG. 2 (Prior Art)
FIG. 2 is a schematic sectional view of a second microwave oven according to the prior art.
Figure 3:
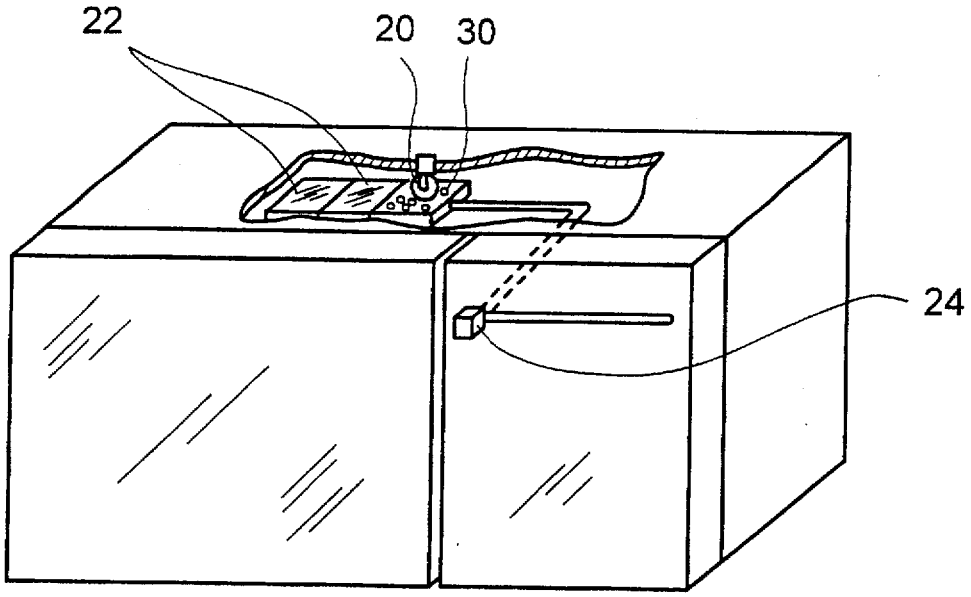
FIG. 3 (Prior Art)
FIG. 3 is a longitudinal sectional view of a third microwave oven according to the prior art.
Figure 4:
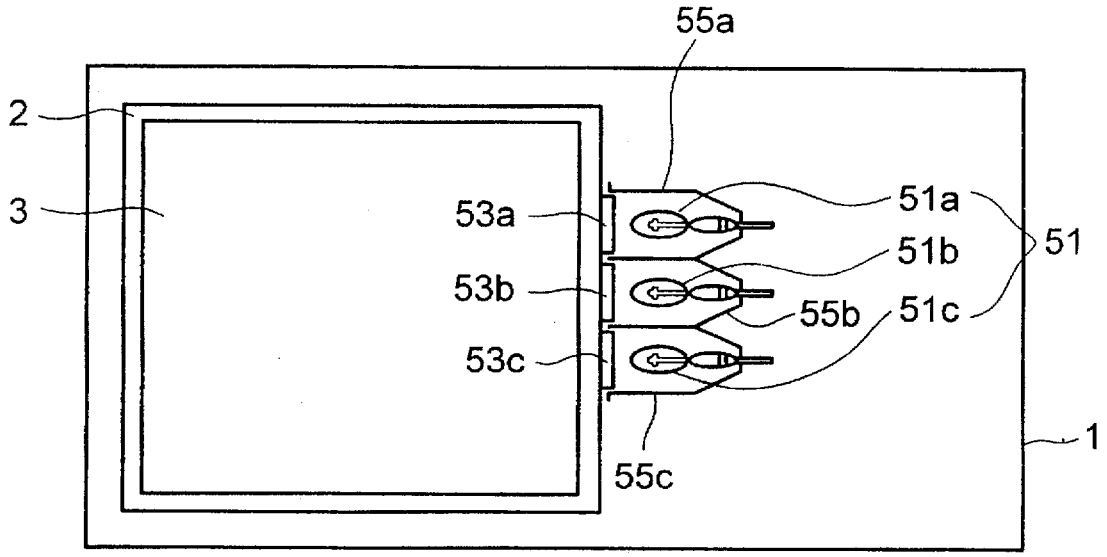
FIG. 4 is a schematic diagram of a microwave oven employing an illumination apparatus according to a first embodiment of the present invention.
Figure 5:
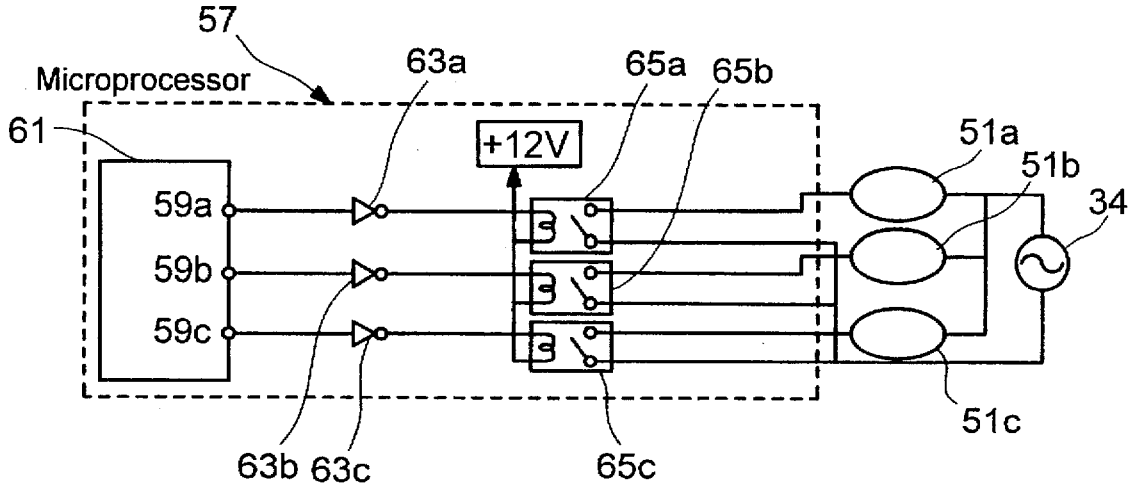
FIG. 5 is a circuit diagram for driving the illumination apparatus in FIG. 4.

The illumination apparatus of a microwave oven according to the first embodimeent of the present invention is disposed at one lateral wall surface in the cooking chamber 3 of the body 1 as illustrated in FIGS. 4 and 5, and is contructed to have two large parts, namely, a plurality of illumination means 51 for illuminating the cooking chamber 3 with respectively different colors of light and driving means 57 for driving the illumination means 51.

At this location,, although detailed illustrations are not provided in the drawing, the cooking chamber 3 is formed, at a corresponding wall surface thereof where the illumination means 51 is disposed, with a through hole to allow the light to iluminate the cooking chamber.

As the plurality of illumination means 51, three lamps 51*a*, 51*b* and 51*c* are provided at one lateral wall surface of the cooking chamber 3 so as to emit the same color of light (by way of example, color of incandescent light), and the lamps 51*a*, 51*b* and 51*c* are respectively provided at front sides thereof with glass plates 53*a*, 53*b* and 53*c* of respectively different colors (by way of example, blue, red and yellow). The lamps 51*a*, 51*b* and 51*c* are also provided with reflective plates 55*a*, 55*b* and 55*c* in order to reflect the light emitted from the lamps in a predetermined direction.

Alternatively, the illumination means 51 could employ three lamps for directly emitting respectively different colors of light (by way of example, blue, yellow and red lamps), unlike the above-mentioned description.

Meanwhile, the driving means 57 for driving the lamps 51*a*, 51*b* and 51*c* of the illumination means 51 includes, as illustrated in FIG. 5, a microprocessor 61 for receiving a predetermined data for cooking the food and employing three output ports 59*a*, 59*b* and 59*c*, three inverters 63*a*, 63*b* and 63*c* for receiving an output signal from the microprocessor 61 and inversely transforming a signal characteristic thereof to thereafter output same, and three relays 65*a*, 65*b* and 65*c* for switching on and switching off a signal having passed the inverters 63*a*, 63*b* and 63*c* to thereby light up or turn off the corresponding lamps.

The inverters 63*a*, 63*b* and 63*c* are constituted by NOT gates for inverting an input signal to thereby output same. The microprocessor 61 is inherently housed by a clock counter for clocking up progressive time according to advancement of the cooking.

Figure 6:
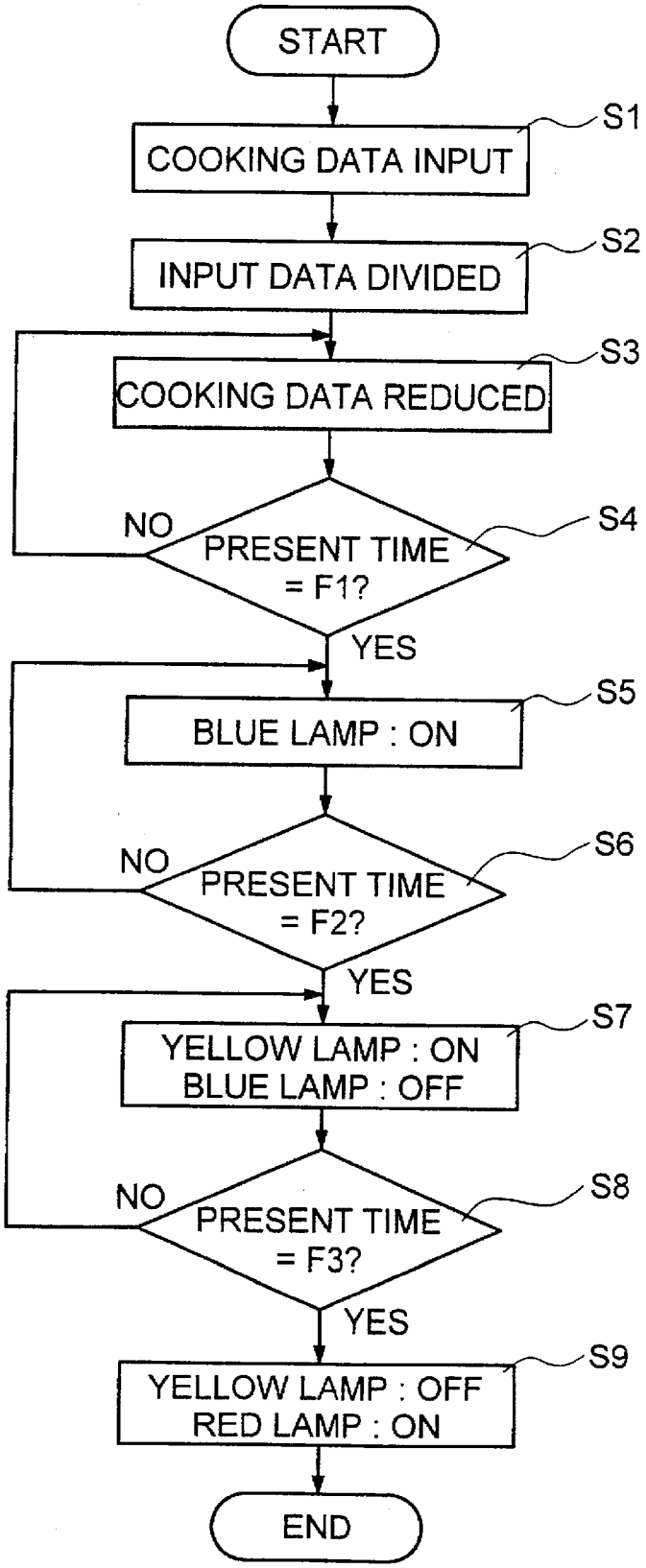
FIG. 6 is a flow chart for illustrating operational procedures of the illumination apparatus of a microwave oven according to the first embodiment of the present invention.

Operation of the illumination apparatus of a microwave oven and control method thereof according to the first embodiment of the present invention constructed as above will be described with reference to FIGS. 4, 5 and 6. Reference symbol S denotes steps.

First of all, when the food is to be cooked by a microwave oven, the user selects cooking menu, cooking time and the like by way of a manipulating unit (not shown) on the microwave oven.

Successively, at step S1, a cooking data according to the cooking menu selected therefrom is input to the microprocessor 61. At step S2, input time data of the input cooking data is classified into three steps, the microprocessor 61 wherein a predetermined program and the like are stored for controlling the light-up and put-out of the lamps 51*a*, 51*b* and 51*c*.

In other words, the input time data is divided into three steps or phases so that light of respectively different colors (by way of example, blue, yellow and red) can be used to illuminate the cooking chamber 3 according to cooking progressive time steps.

Then, at step S3, when the cooking is started, the cooking progressive time is clocked up by the clock counter inherently housed in the microprocessor 61, and the data divided per time step is gradually reduced.

In step S4 the elapsed time from the clock counter is compared with a first phase F1 of the divided input time data. If the elapsed time corresponds to the first phase F1 (i.e. with the first third of the input time data), then a first port 59*a* out of the three ports 59*a*, 59*b* and 59*c* serves to transmit a signal of high level.

The signal is now converted to a signal of low level via the inverter 63*a* and the first relay 65*a* is rendered activated by the signal of low level to thereby light up the first lamp 51*a*.

Accordingly, a blue light is illuminated in the cooking chamber 3 because the blue glass plate 53*a* is mounted at a front side of the first lamp 51*a*.

Meanwhile, at step S6, when the clocked-up time obtained by the clock counter reaches a second phase (F2) during the progress of, the cooking time, a signal of low level is generated from the first port 59*a* of the microprossor 61, which is converted to a signal of high level and output while passing through the inverter 63*a*.

Then, the first relay 65*a* is rendered deactivated and the first lamp 51*a* is turned off.

The second port 59*b* at the microprocessor 61 serves to send out a signal of high level at the same time.

The signal of high level is changed to a signal of low level in the course of passing through the inverter 63*b* and is output. As a result thereof, the second relay 65*b* is rendered activated while the second lamp 51*b* is turn off.

Accordingly, at step S7, a yellow light is illuminated in the cooking chamber 3 because the yellow glass plate 53*b* is disposed at a front side of the second lamp 51*b*.

Likewise, at step S8, when the checked time by the clock counter reaches a third phase (F3) during the progress of the cooking time, the second port 59*b* at the microprocessor 61 serves to send out a signal of low level according to the same operational principal mentioned as above to thereby turn off the second lamp 51*b*.

At the same time, at step 59, a signal of high level is generated from the third port 59*c* to thereby light up the third lamp 51*c*.

Accordingly, the cooking chamber 3 is illuminated in red light because the third lamp 51*c* is provided at a front side thereof with a red glasss plate 53*c*.

As mentioned above, according to the first embodiment of the present invention, there is an advantage in that the interior of the cooking chamber is illuminated by different colors according to cooking progressive time by way of glass plates mounted with separately different colors, so that the user can ascertain the cooked condition of the food at a distance.

Next, the illumination apparatus of a microwave oven according to the second embodiment of the present invention will be described in detail.

Figure 7:
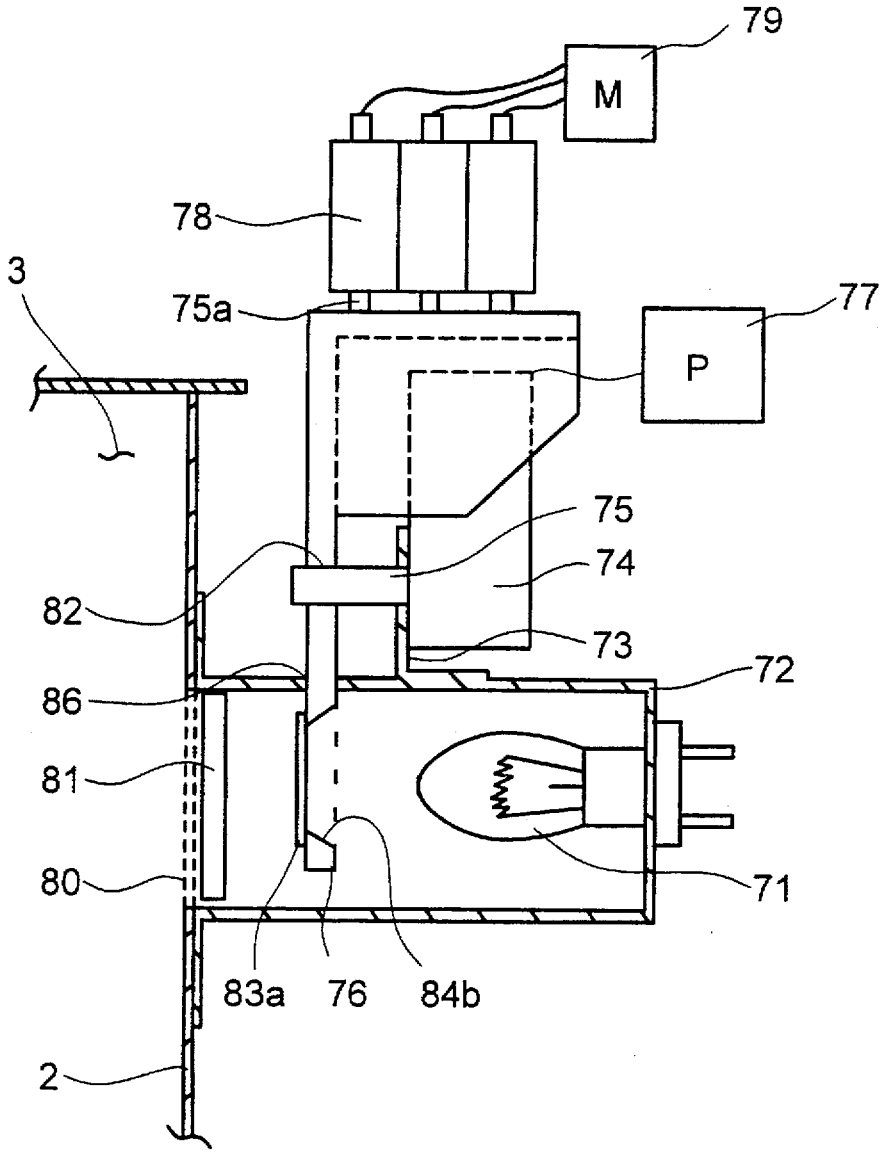
FIG. 7 is a schematic view of an illumination apparatus of a microwave oven according to a second embodiment of the present invention.
Figure 8:
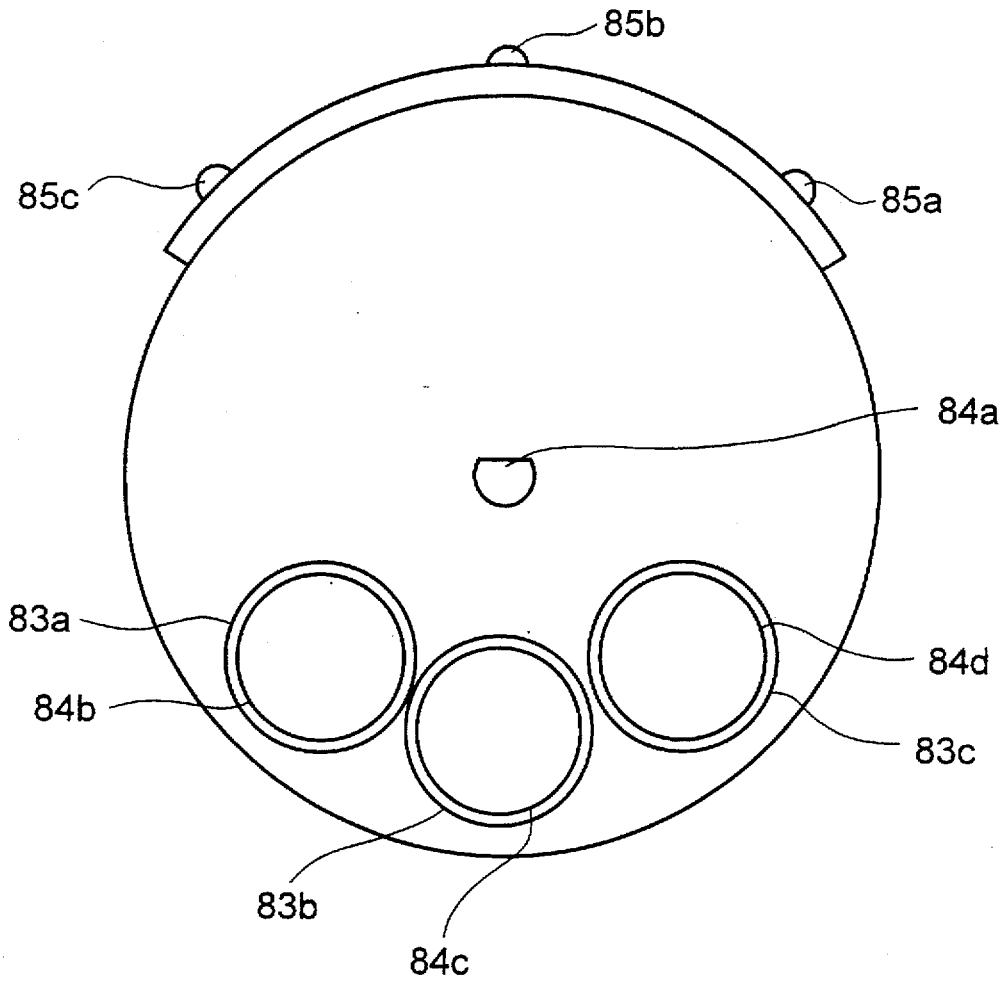
FIG. 8 is a plan view of a color changing turning plate in FIG. 7.
Figure 9:
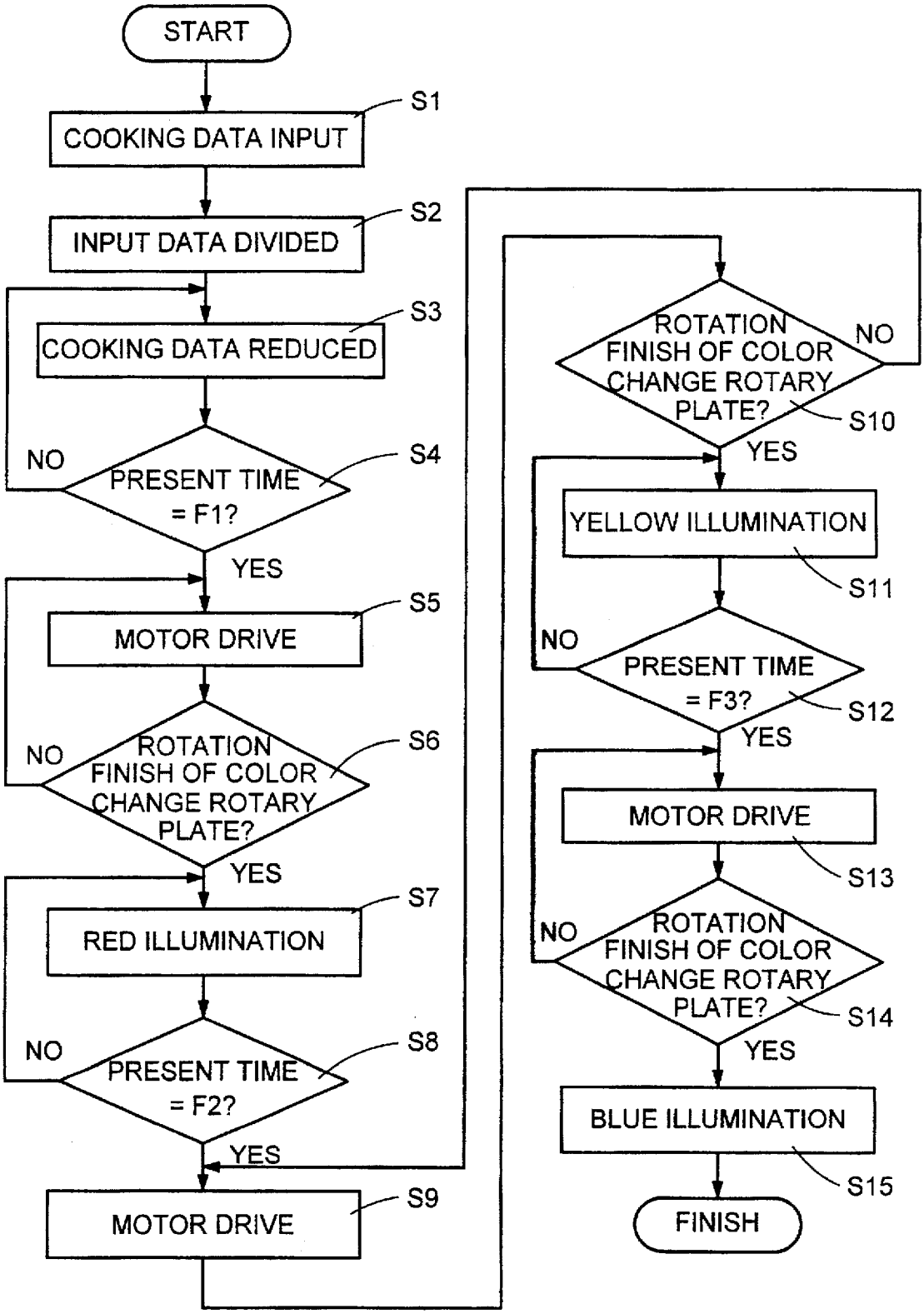
FIG. 9 is a flow chart of operational procedures of an illumination apparatus of a microwave oven according to the second embodiment of the present invention.

The second embodiment of the present invention is largely constructed with control means and illumination means, as illustrated in FIGS. 7 and 8.

In other words, the illumination means 200 includes, as illustrated in FIGS. 7 and 8, a lamp 71 for emitting light in order to illuminate the cooking chamber 3, a cover member 72 for housing the lamp 71, a motor 74 for being fixed to a fixing plate 73 protrudingly disposed at one side of the cover member 72 so that a color change rotary plate (described later) can be rotated. The color change rotary plate 76 is coupled to an axle 75 of the motor 74 in order to change colors according to the cooking time or food heating temperature in the cooking chamber 3. And power source means 77 is provided for applying or cutting off an electric power source to the motor 74.

The control means includes a detecting switch 78 for detecting a position rotary of the color change rotary plate 76, and a microprocessor 79 for receiving a position signal from the detecting switch 78 to either stop the motor 74, so that the color change rotary plate 76 can be stopped from rotating, or drive the motor 74, so that the color change rotary plate 76 can be rotated. The microprocessor 79 is inherently provided with a clock counter for counting the cooking progressive time.

A wall unit 2 for partitioning the cooking chamber 3 is provided with a project window 80 to allow the light of the lamp 71 to be projected into the cooking chamber 3, and the project window 80 is arranged at one side thereof with a glass plate 81 for protecting the project window 80 at a certain area thereof through which the light is transmitted.

The color change rotary plate 76 is formed at an approximate central area thereof with a through hole 82 to receive the axle 75.

The color change rotary plate 76 is formed at one side thereof with first, second and third cylindrical holes 84*b*, 84*c* and 84*d* covered by respective color film sheets 83*a*, 83*b* and 83*c*, so that the color by which the cooking chamber is illuminated can be changed according to the food heating temperature and cooking time in the cooking chamber 3 when the motor 74 is driven.

The color change rotary plate 76 is also formed at a periphery thereof with a plurality of protruders 85*a*, 85*b* and 85*c* for contacting the detecting switch 78 in order to enable a position of the color change rotary plate 76 to be detected.

Meanwhile, the color film sheets 83*a*, 83*b* and 83*c* are made of mutually different colors such as red, yellow, blue and the like (Reference numerals 83*a*, 83*b* and 83*c* are respectively coded as a red, a yellow and a blue film sheet in a later description).

Furthermore, the cover member 72 is mounted, at one side thereof with a through hole 86, to accommodate the color change rotary plate 76.

Next, the operational process of the second embodiment of the present invention constructed as above and effect thereof will be described.

First of all, when the food is to be cooked by a microwave oven, the user selects the cooking menu, cooking time and the like by way of a manipulating unit (not shown) of the microwave oven.

Successively, at step S1, cooking data from the cooking menu selected by the user is input to the microprocessor 79. At this time, time data out of input cooking data is divided into 3 steps or phases at step S2, by the microprocessor 79 where a predetermined program and the like for controlling the switch-on and the switch-off of the lamp 71 is stored.

In other words, the time data is divided into three (3) different phases so that mutually different colors (by way of example, blue, yellow and red) can be used to illumination the cooking chamber according to the cooking progressive time.

Then, when the cooking starts, the cooking progressive time is checked by the clock counter inherently stored in the microprocesssor 79, and the divided data is gradually reduced at step S3.

After a predetermined time lapse, a comparison is made at step S4 between the time checked by the clock counter and the divided input time data, and if the checked time is within a period of a first phase, the electric power source is applied to the motor 74 from the power source means 77 according to a control signal of the microprocessor 79 to drive the motor 74 (step S5).

Accordingly, the color change rotary plate 76 connected to the axle 75 is cooperatively rotated, and the protruder 85*a* formed at the periphery of the color change rotary plate 76 contacts the detecting switch 78, and a detected signal is input to the microprocessor 79.

Accordingly, the motor 74 is stopped by the control signal of the microprocessor 79, to thereby stop rotation of the color change rotary plate 76 (Step S6).

At this time , the light emitted from the lamp 71 serves to penetrate the red film sheet 83*a* attached to the first cylindrical hole 84*b* of the color change rotary plate 76, so that the red light can illuminate the interior of the cooking chamber 3 through the project window 80.

Meanwhile, when the checked time by the clock counting operation of the microprocessor 79 reaches a second phase, the motor 74 is driven, step S9, by the control signal of the microprocessor 79, and when the color change rotary plate 76 is rotated to a predetermined angle, step S10, the protruder 85*b* formed at the periphery of the color change rotary plate 76 is caused to contact the control switch 78, so that the detected signal thereof is input to the microprocessor 79.

Accordingly, the motor 74 is stopped by the control signal from the microprocess 79, thereby stopping rotation of the color change rotary plate 76.

At this time, the light emitted from the lamp 71 serves to penetrate the yellow film sheet 83*b* attached to the second cylindrical hole 84*c* of the color change rotary plate 76, and the yellow light illuminates the interior of the cooking chamber 3 through the project window 80 (step S11).

Furthermore, when the checked time arrives at a third step, step S12, the motor 74 is driven, step S13, by the control signal of the microprocessor 79.

When the color change rotary plate 76 is rotated to a predetermined angle, step S14, the protruder 85*c* formed at the periphery of the color change rotary plate 76 is caused to touch the detecting switch 78 to thereby create a signal which is input to the microprocessor 79.

Accordingly, the motor 74 is stopped by control of the microprocessor 79 and the color change rotary plate 76 is stopped.

At this time, the light emitted from the lamp 71 serves to penetrate the blue film sheet 83*c* attached to the third cylindrical hole 84*d* at the color change rotary plate 76, and blue light is illuminated in the interior of the cooking chamber 3 through the project window 80.

As is apparent from the foregoing, there is an advantage in the second embodiment of the present invention that cylindrical hole in the color change rotary plate are covered by colored film sheets and the rotary plate is caused to rotate for at every predetermined period of time lapse for directing different colors of illumination into the cooking chamber, so that the user can easily ascertain the cooking condition of the food at a distance.

The foregoing description of the preferred embodiments has been presented for the purpose of illustration and description. It is not intended to limit the scope of this invention. Many modifications and variations are posssible in light of the above teaching. It should be noted that the present invention can be applied to all kinds of apparatus within the scope of the above presentation.

What is claimed is:

1. A microwave oven comprising:

a cooking chamber;

a magnetron for supplying high frequency waves to the cooking chamber for cooking food therein;

an illumination mechanism for illuminating the cooking chamber with different respective colors of light, comprising:

a main plate mounted for rotation about an axis, the main plate including a plurality of through-holes formed therein and arranged in circumferentially spaced relationship about the axis of rotation, a plurality of differently colored light-transmitting sheets disposed across respective ones of the through-holes, a light source arranged such that the light transmitting sheets are selectively positionable in a path of light emitted from the light source, an electric motor connected to the main plate for rotating the main plate about the axis, and a detector connected to the control mechanism for detecting a position of the main plate and supplying signals to the control mechanism for controlling operation of the motor to orient a selected one of the light-transmitting sheets in the light path;

a control mechanism connected to the motor to drive the motor and rotate the main plate for progressively changing the colors of illumination in accordance with the progress of a cooking operation.

2. The microwave oven according to claim 1 wherein the detector is a switch engageable by protrusions movable with the main plate.

3. The microwave oven according to claim 1 wherein the cooking chamber is disposed on one side of a wall having a window covered by glass, the illumination mechanism disposed on an opposite side of the wall for directing light through the window.

4. The microwave oven according to claim 1 including a manually operable unit for inputting cooking data, including a cooking time period, the control mechanism connected to the manually operable unit for changing the colors in accordance with respective phases of the input cooking time period.

5. The microwave oven according to claim 1 wherein the control mechanism is operable to change the colors in accordance with changes in temperature of the food being cooked.

6. A method of controlling the illumination of cooking chamber of a microwave oven during a cooking operation, the oven including a light source emitting light in a path directed into the cooking chamber, the method comprising progressively changing the color of the illumination according to the progress of the cooking operation by periodically actuating an electric motor connected to a plate to displace the plate and respective light-transmitting sheets of different colors carried by the plate, for sequentially positioning respective ones of the sheets in the light path at a location between the light source and the cooking chamber, and sensing positions of the plate and supplying, to a control mechanism, signals corresponding to the sensed positions, to cause the motor to stop when a respective sheet is disposed in the light path.

7. The method according to claim 6 further including the step of inputting cooking data prior to commencement of the cooking operation, the data including a cooking time period, the changing step comprising changing the color of the illumination corresponding to respective phases of the cooking time period.

8. The method according to claim 7 wherein the changing step includes dividing the cooking time period into phases corresponding to the number of colors, measuring the elapsed cooking time during a cooking operation, and comparing the elapsed time with reference values corresponding to the phases.

9. The method according to claim 6 wherein the changing step comprises changing the color of the illumination according to the temperature of the food being cooked.

* * * * *